US012257526B2

(12) United States Patent
Hsu

(10) Patent No.: US 12,257,526 B2
(45) Date of Patent: Mar. 25, 2025

(54) ASSEMBLABLE POLYGONAL THREE-DIMENSIONAL BUILDING BLOCKS

(71) Applicant: Hao-Hsuan Hsu, Taichung (TW)

(72) Inventor: Hao-Hsuan Hsu, Taichung (TW)

( * ) Notice: Subject to any disclaimer, the term of this patent is extended or adjusted under 35 U.S.C. 154(b) by 240 days.

(21) Appl. No.: 18/132,419

(22) Filed: Apr. 10, 2023

(65) Prior Publication Data

US 2024/0075399 A1 Mar. 7, 2024

(30) Foreign Application Priority Data

Sep. 1, 2022 (TW) ..... 111209491

(51) Int. Cl.
*A63H 33/04* (2006.01)

(52) U.S. Cl.
CPC ..... *A63H 33/046* (2013.01)

(58) Field of Classification Search
CPC ..... A63H 33/04; A63H 33/046
See application file for complete search history.

(56) References Cited

U.S. PATENT DOCUMENTS

| | | | | |
|---|---|---|---|---|
| 7,066,778 | B2 * | 6/2006 | Kretzschmar | A63H 33/046 446/124 |
| 7,787,990 | B2 * | 8/2010 | Pietrzyk | A63H 33/042 446/85 |
| 9,320,980 | B2 * | 4/2016 | Schweikardt | A63H 33/046 |
| 9,339,736 | B2 * | 5/2016 | Howard | A63F 9/1208 |
| 10,293,482 | B2 * | 5/2019 | Buthala | A63H 33/042 |

* cited by examiner

*Primary Examiner* — John A Ricci
(74) *Attorney, Agent, or Firm* — Bruce Stone LLP; Joseph A. Bruce

(57) ABSTRACT

A polygonal three-dimensional building blocks comprises: a main body having a central area and at least three abutment side walls, the central area located among the abutment side walls; the abutment side walls connected to each other in a ring shape and having a slanted surface respectively, each one of the abutment side walls having a first side edge and a second side edge respectively, the first side edge and the second side edge arranged at two opposite sides of each one of the abutment side wall, the central area located between the first side edges of the abutment side walls, the abutment side walls having an inner surface and an outer abutment surface opposite from each other; the main body having a plurality of magnetic attachment areas; a plurality of magnetic members installed at the magnetic attachment areas.

4 Claims, 10 Drawing Sheets

ASSEMBLABLE POLYGONAL THREE-DIMENSIONAL BUILDING BLOCKS

BACKGROUND OF THE INVENTION

Technical Field

The present invention is related to a three-dimensional building block, and in particular, to an assemblable polygonal three-dimensional (3D) building block.

Description of Related Art

During the learning and growth process of infants or preschool children, different teaching instruments are used to simulate children's brains. Among various types of teaching instruments, building block type of teaching instrument is widely accepted by teachers and parents. However, known assemblable building blocks allow stacking and mounting only, and the blocks assembled completely cannot be secured firmly, such that building blocks tend to fall off during the assembly process, and the quality of the game entertainment can be affected.

In addition, known teaching instruments equipped with magnets are mostly in planar shapes such that their variation and diversity are limited. Accordingly, there is a need for an assemblable polygonal 3D building block.

BRIEF SUMMARY OF THE INVENTION

The present invention provides an assemblable polygonal 3D building block, and a primary objective is to provide a polygonal 3D building block capable of being assembled to each other in order to form different 3D shapes.

Another objective of the present invention is to control the assembly shape of a plurality of polygonal 3D building blocks via a circuit.

To achieve the aforementioned objectives, the present invention provides an assemblable polygonal 3D building block, comprising:

A main body having a central area and at least three abutment side walls, the central area located among the abutment side walls;

The abutment side walls connected to each other in a ring shape and having a slanted surface respectively, each one of the abutment side walls having a first side edge and a second side edge respectively, the first side edge and the second side edge arranged at two opposite sides of each one of the abutment side wall, the central area located between the first side edges of the abutment side walls, the abutment side walls having an outer abutment surface;

The main body having a plurality of magnetic attachment areas; and

A plurality of magnetic members installed at the plurality of magnetic attachment areas.

Preferably, it further comprises a control circuit module, the plurality of magnetic members being electromagnets, and the control circuit module electrically connected to the plurality of magnetic members.

In view of the above, it can be understood that the present invention mainly utilizes at least three abutment side walls of the main body, the abutment side walls are slanted surfaces, and a plurality of magnetic attachment areas are formed on the main body along with a plurality of magnetic members installed at the magnetic attachment areas, such that assembly can be performed to achieve the effect of forming polygonal 3D building block of different 3D shapes.

Furthermore, the present invention further utilizes the control circuit module 50 to control the magnetic attachment of the magnetic members M, such that the attachment method of each polygonal 3D building block can be controlled independently, in order to change the arrangement type of each polygonal 3D building block K via remote control method.

DETAILED DESCRIPTION OF THE INVENTION

Figure 1:
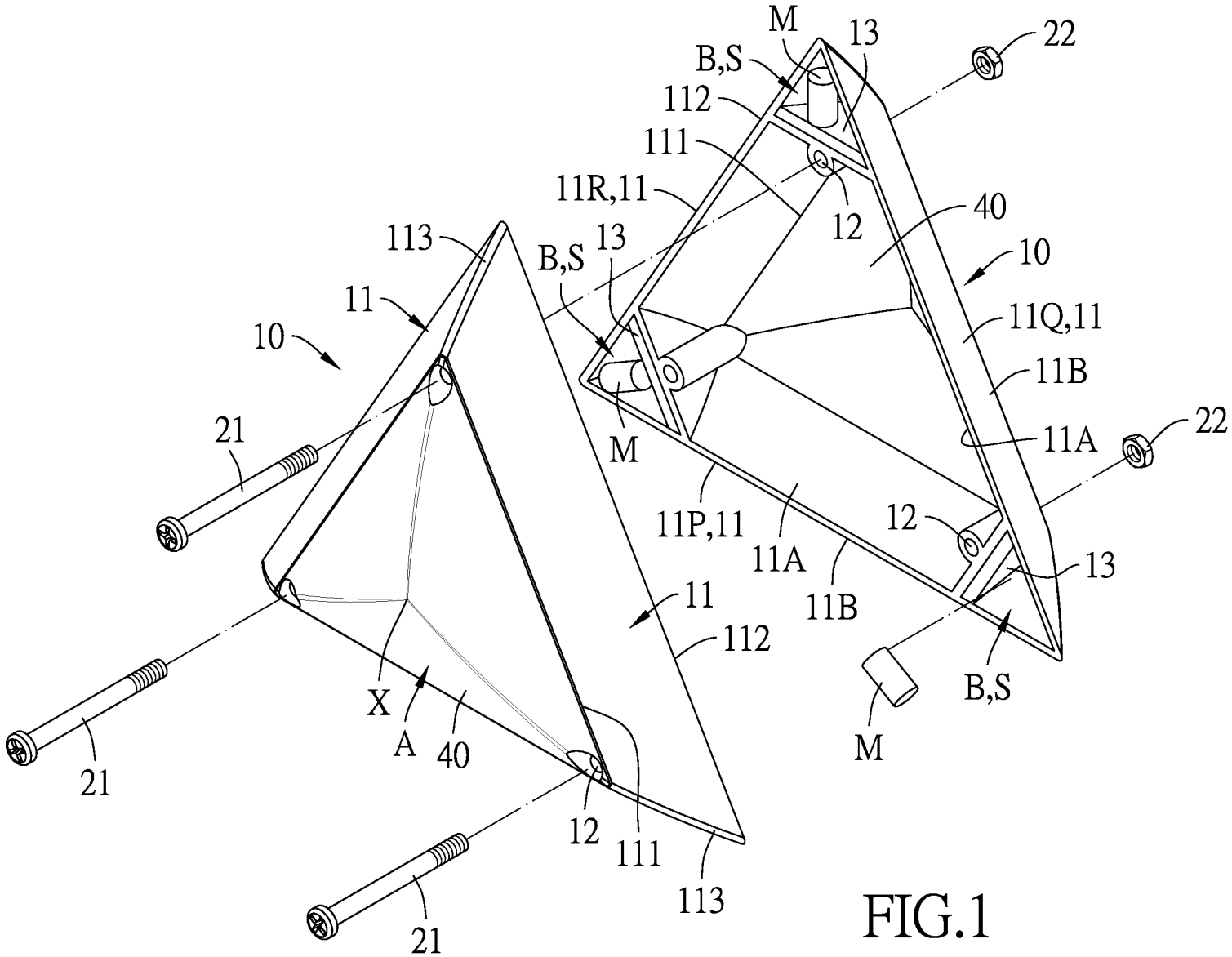
FIG. 1 is an exploded view of the assemblable polygonal 3D building block according to an embodiment of the present invention.

The present invention provides an assemblable polygonal 3D building block K, and according to an embodiment of the present invention, as shown in FIGS. 1 to 13, comprising:

A main body 10 having a central area A and at least three abutment side walls 11, the central area A located among the abutment side walls 11, and the abutment side walls 11 are trapezoidal;

The abutment side walls 11 connected to each other in a ring shape, and the abutment side walls 11 having a slanted surface respectively, each one of the abutment side walls 11 having a first side edge 111, a second side edge 112 and two connecting side edges 113 respectively, the first side edge 111 and the second side edge 112 arranged at two opposite sides of each one of the abutment side wall 11, the central area A located between the first side edges 111 of the abutment side walls 11, the abutment side walls having an outer abutment surface. In this embodiment, a length of the second side edge 112 is greater than a length of the first side edge 111. The first side edges 111 and the second side edges 112 each have one connected with one of the connecting side edges 113, and have the other end connected with the other connecting side edge 113, and the connecting side edges 113 of each of the abutment side walls 11 are connected with each other. The abutment side walls 11 each have an inner surface 11A and an outer abutment surface 11B opposite from each other;

In this embodiment, as shown in FIG. 1, the quantity of the abutment side walls 11 is three, and abutment side walls 11 are defined to be a first abutment side wall 11P, a second abutment side wall 11Q, and a third abutment side wall 11R; one end of the first abutment side wall 11P is connected to the second abutment side wall 11Q, and another end of the first abutment side wall 11P is connected to the third abutment side wall 11R; the second abutment side wall 11Q is connected to the another end of the first abutment side wall 11P that is connected to the third abutment side wall 11R, such that the abutment side walls 11 are connected to each other in a ring shape.

The main body 10 having a plurality of magnetic attachment areas B;

A plurality of magnetic members M installed at the plurality of magnetic attachment areas B.

Figure 11:
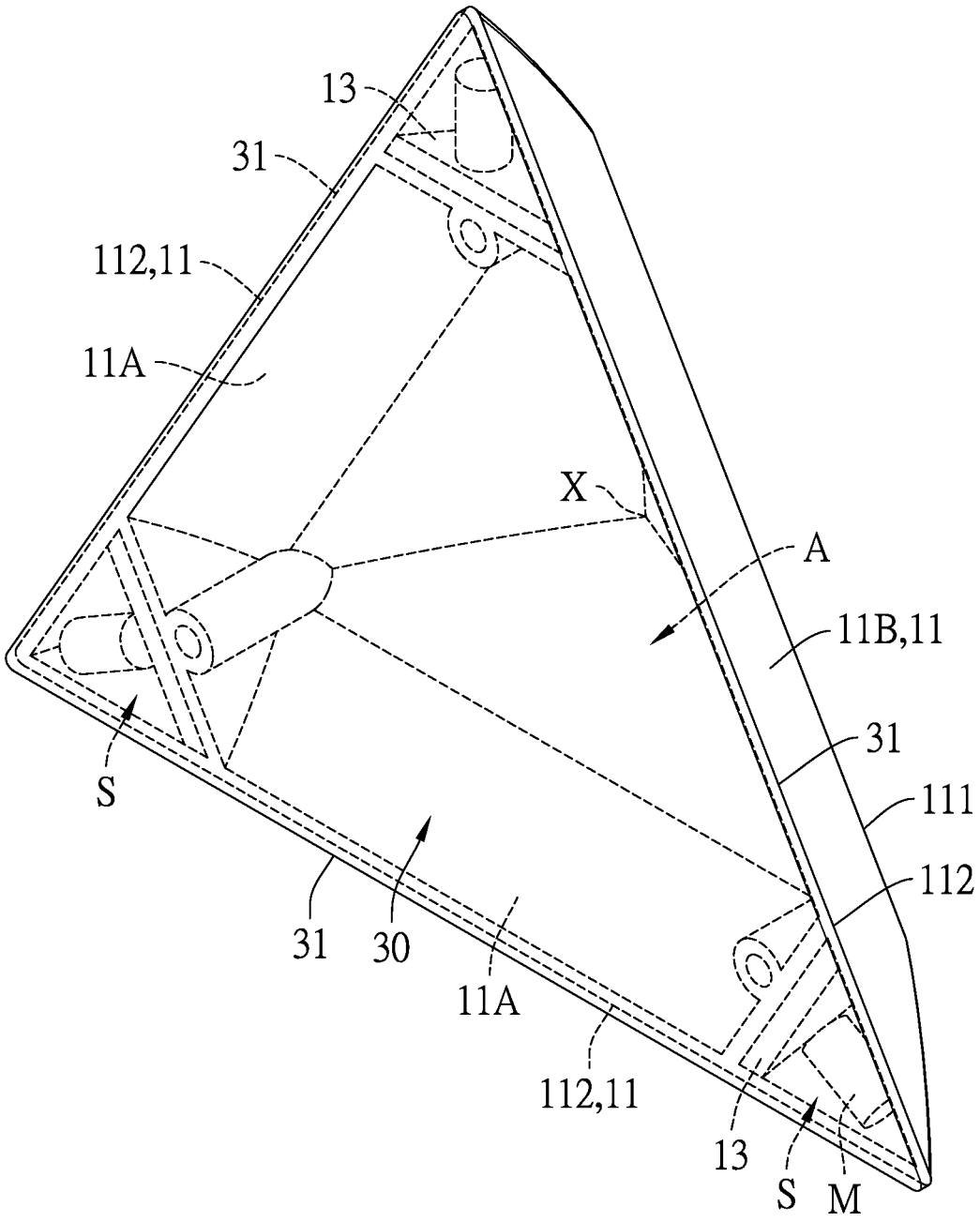
FIG. 11 is a schematic view of the assemblable polygonal 3D building block according to a preferred embodiment of the present invention.

As shown in FIG. 11, a sealing side wall 30 is connected between the second side edges 112, the sealing side wall 30 includes a plurality of connecting side edges 31, and the quantity of the abutment side walls 11 is equivalent to the quantity of the side edges 31 of the sealing side wall 30. In this embodiment, the quantity of the abutment side walls 11 is three, the sealing side walls 30 has an triangular shape, the quantity of the side edges 31 is three, and the sealing side walls 30 seal the space S.

Figure 2:
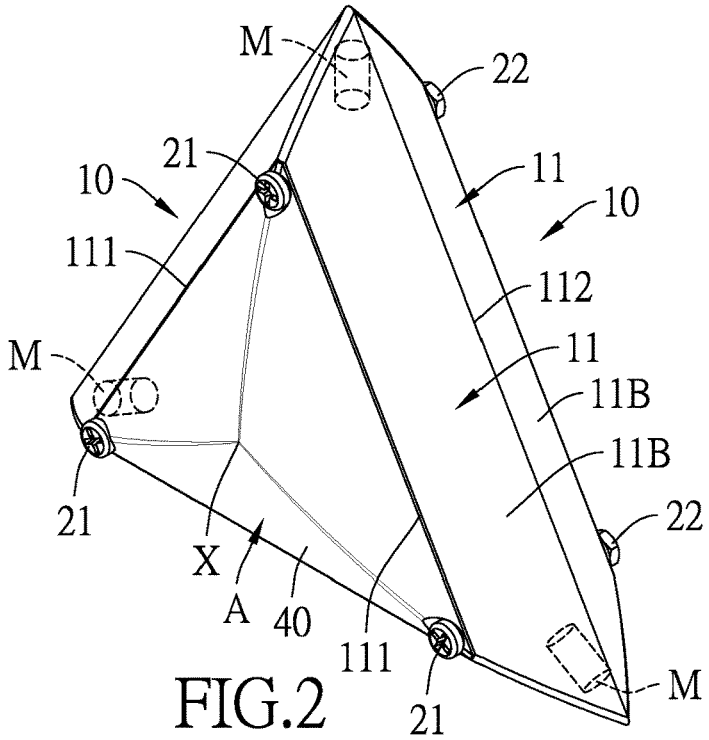
FIG. 2 is a perspective view of the assemblable polygonal 3D building block according to an embodiment of the present invention.
Figure 3:
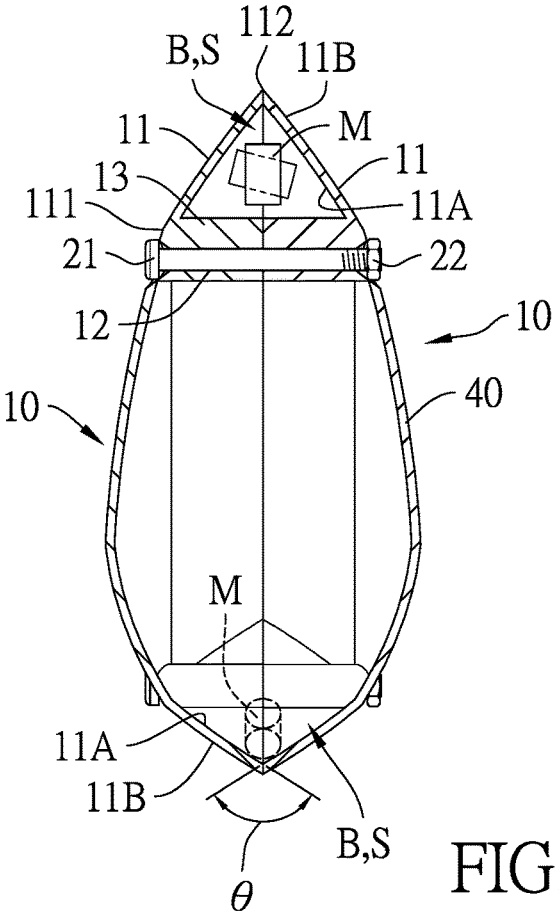
FIG. 3 is a cross sectional view of the assemblable polygonal 3D building block according to an embodiment of the present invention.

In another embodiment, as shown in FIGS. 1-3, the quantity of the main body 10 is two. The two main bodies 10 are attached to each other, and the second side edges 112 of the two main bodies 10 abut against each other. The two main bodies 10 further includes three fastening holes 12, three bolts 21 and three nuts 22. The bolts 21 penetrate through the fastening holes 12 of the two main bodies 10, and the nuts 22 are fastened on the bolts 21 respectively in order to attach the two main bodies 10. Accordingly, the user is able to change the magnetic members M or other component parts in the two main bodies 10 conveniently.

In this embodiment, please refer to FIG. 3, the abutment side walls 11 of the two main bodies 10 together define an included angle θ, and the included angle θ ranges between 30 and 120 degrees, thereby making the abutment side walls 11 of the polygonal building blocks K more stable when they are abutted against each other, and the included angles θ have different values so that these polygonal building blocks K can form different shapes and define different types of space.

Figure 7:
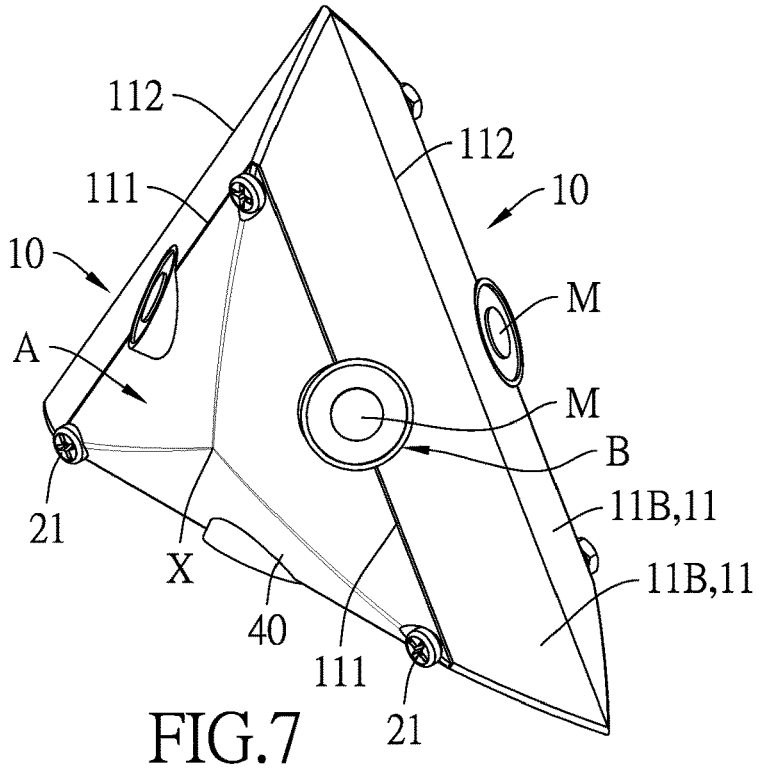
FIG. 7 is a perspective view of the assemblable polygonal 3D building block according to another embodiment of the present invention.

In another embodiment, as shown in FIG. 7, the magnetic attachment areas B are located at the outer abutment surface 11B, and the plurality of magnetic members M are installed on the outer abutment surface 11B.

In another embodiment, as shown in FIGS. 1~3 and 11, the main body 10 further includes a plurality of inner walls 13, and each one of the inner walls 13 is connected to the inner surfaces 11A of the two abutment side walls 11. A space S is formed and surrounded by the inner wall 13 and the two abutment side walls 11. The space S refers to the magnetic attachment area B, and the plurality of magnetic members M are arranged inside the space S. In this embodiment, the quantity of the inner wall is three, and each one of the inner walls 13 and the inner surfaces 11A of the abutment side walls 11 form the three spaces S respectively, and such spaces S are located at the corners of the main body 10.

The center location of the central area A is defined to have a center point X. The first side edge 111 is closer to the center point X in comparison to the second side edge 112, allowing the abutment side wall 11 to form a slanted surface.

In an embodiment, as shown in FIGS. 1~3, 8 and 9, the central area A includes a central housing 40, and the central housing 40 is connected to the first side edge 111 of the abutment side walls 11. The central housing 40 can be installed with solar panel or different decorative panels, in order to achieve functional and special visual effects.

Figure 6:
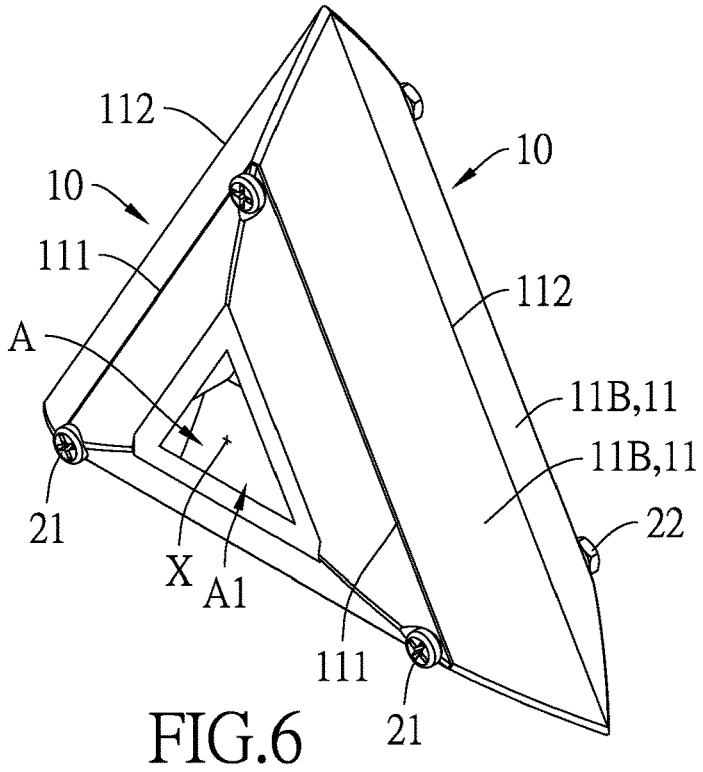
FIG. 6 is a perspective view of the assemblable polygonal 3D building block according to another embodiment of the present invention.

In another embodiment, as shown in FIG. 6, the central area A includes a central through hole A1.

Figure 8:
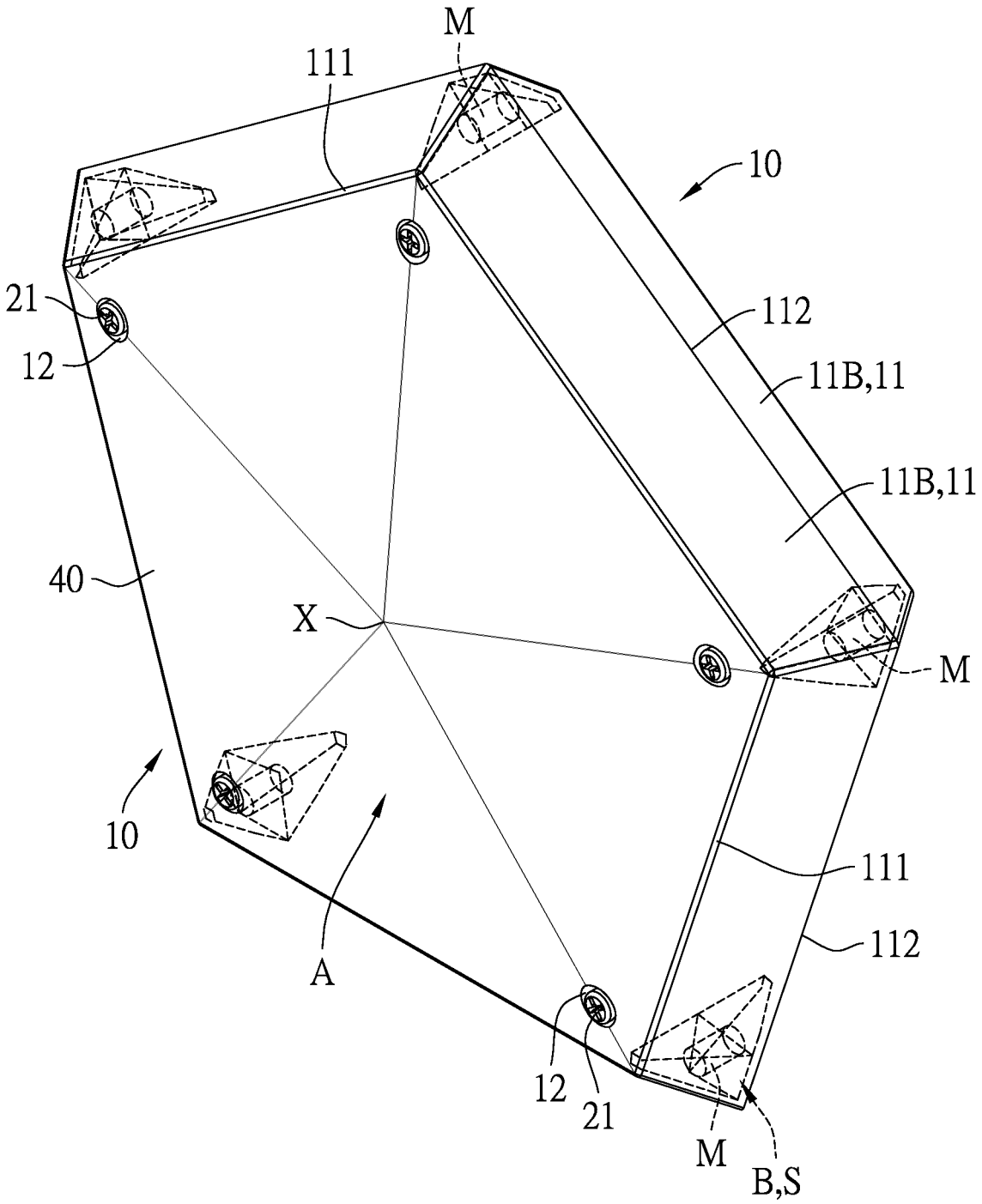
FIG. 8 is a perspective view of the assemblable polygonal 3D building block of the present invention in the shape of a pentagon with twelve surfaces.

In another embodiment, as shown in FIG. 8, the quantity of the abutment side walls 11 of each one of the main body 10 is five, and the quantity of the main body is two. The two main bodies 10 are attached to each other such that the polygonal 3D building block K is in the shape of a pentagon with twelve surfaces.

Figure 9:
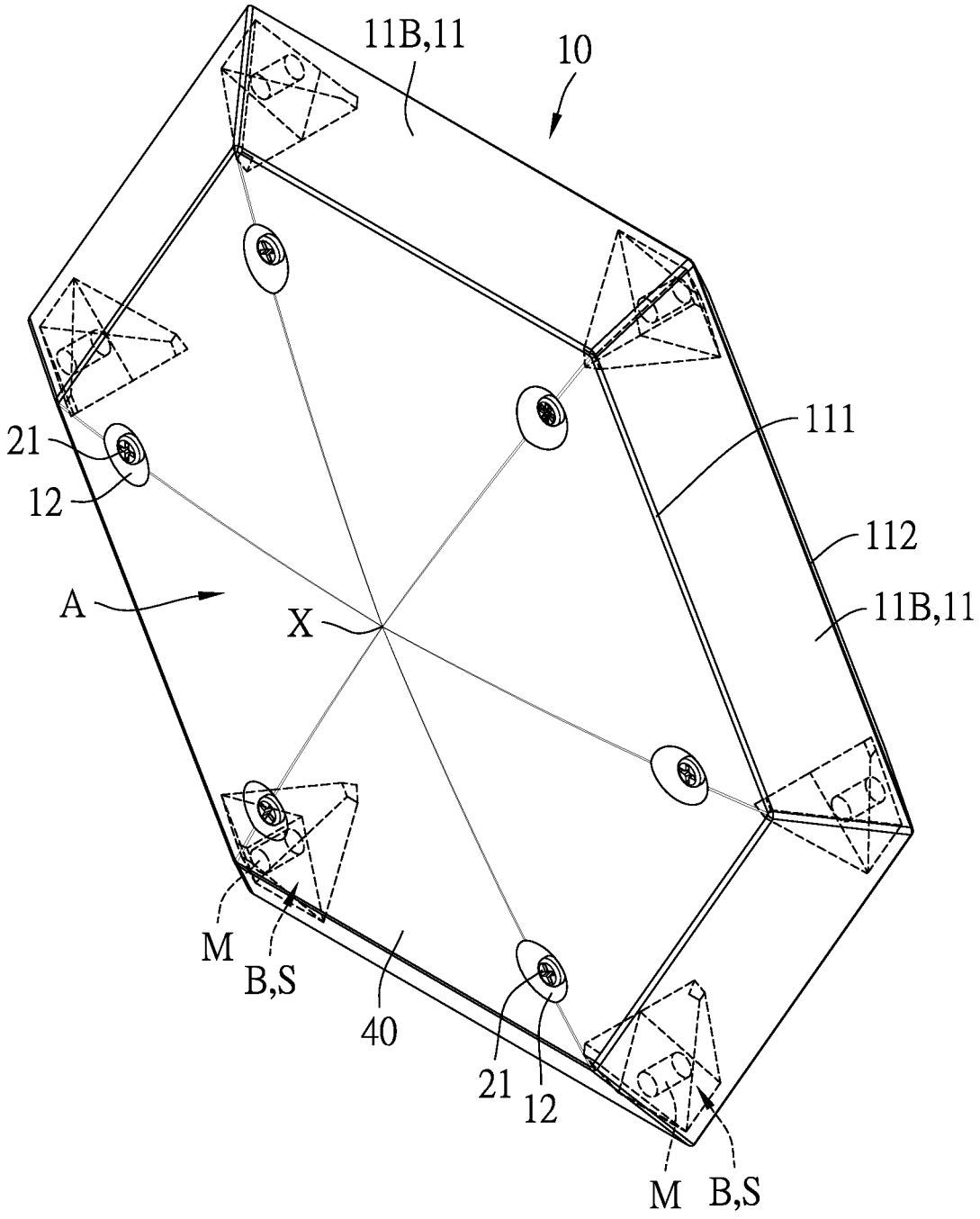
FIG. 9 is a perspective view of the assemblable polygonal 3D building block of the present invention in the shape of a hexagon with fourteen surfaces.

In another embodiment, as shown in FIG. 9, the quantity of the abutment side walls 11 of each one of the main body 10 is six, and the quantity of the main body is two. The two main bodies 10 are attached to each other such that the polygonal 3D building block K is in the shape of a hexagon with fourteen surfaces.

Figure 10:
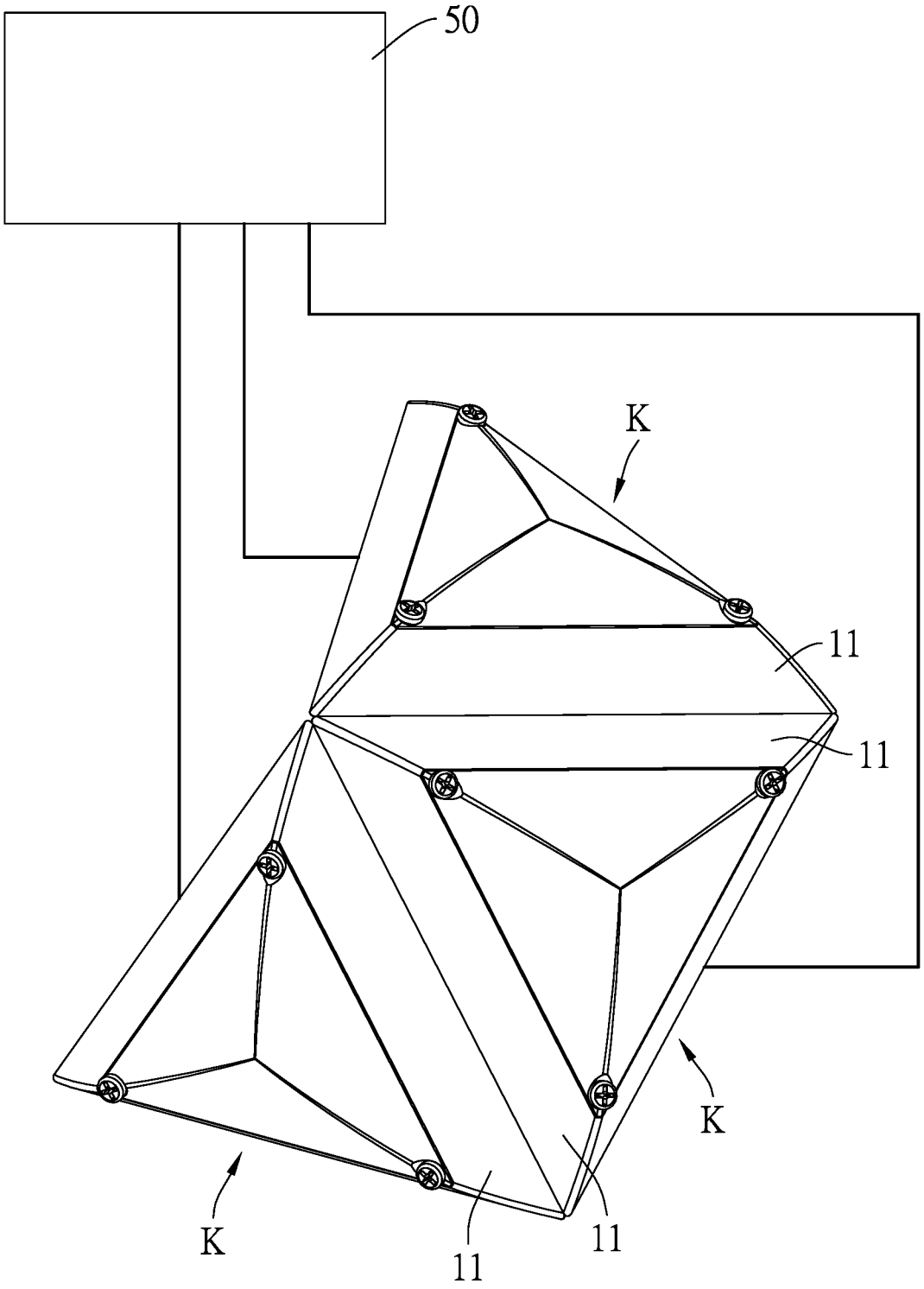
FIG. 10 is a schematic view of the assemblable polygonal 3D building block according to a preferred embodiment of the present invention.

In a preferred embodiment, as shown in FIG. 10, it further includes a control circuit module 50, and the plurality of magnetic members M are electromagnets. The control circuit module 50 is electrically connected to the plurality of magnetic members M. The control circuit module 50 and the plurality of magnetic members M can be electrically connected to each other via wired or wireless method, such that the control circuit module 50 can be operated to control the magnetic attachment or release of the magnetic members M. Accordingly, the assembly relationship of each one of the polygonal 3D building block K can be changed via external control.

Figure 12:
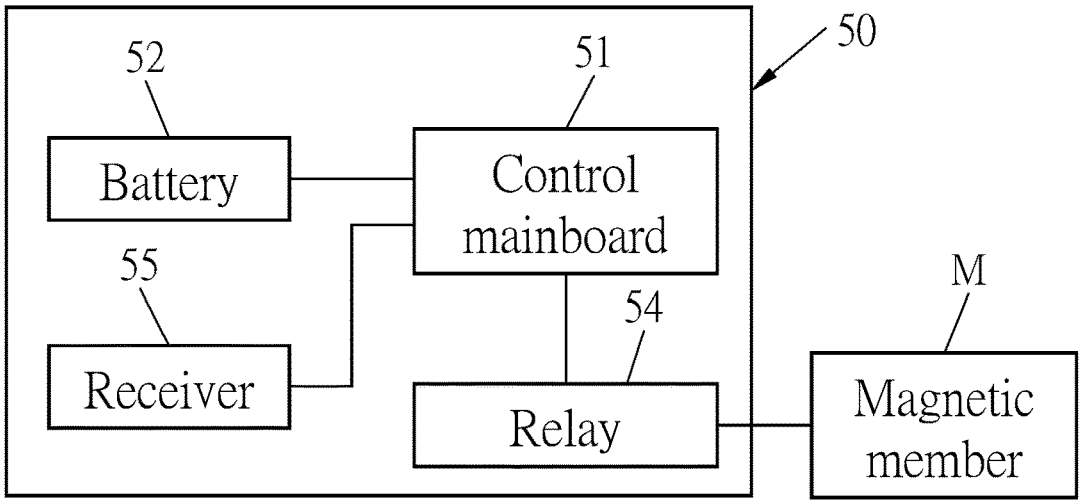
FIG. 12 is a schematic view of the control circuit module of the present invention.

Preferably, as shown in FIG. 12, the control circuit module 50 comprises: a control mainboard 51, a battery 52, a relay 54 and a receiver 55. The receiver 55 is signally connected to the control mainboard 51, the battery 52 is electrically connected to the control mainboard 51, the control mainboard 51 is electrically connected to the relay 54 for controls, and the relay 54 is electrically connected to the plurality of magnetic members M. The receiver 55 is provided to receive an external signal and to transmit the external signal to the control mainboard 51. Accordingly, the control mainboard 51 is able to control the relay 54 to be at an open state or a closed state based on the external signal in order to control the magnetic members M for magnetic attachment or release. The battery 52 is provided to supply an electrical power.

Figure 13:
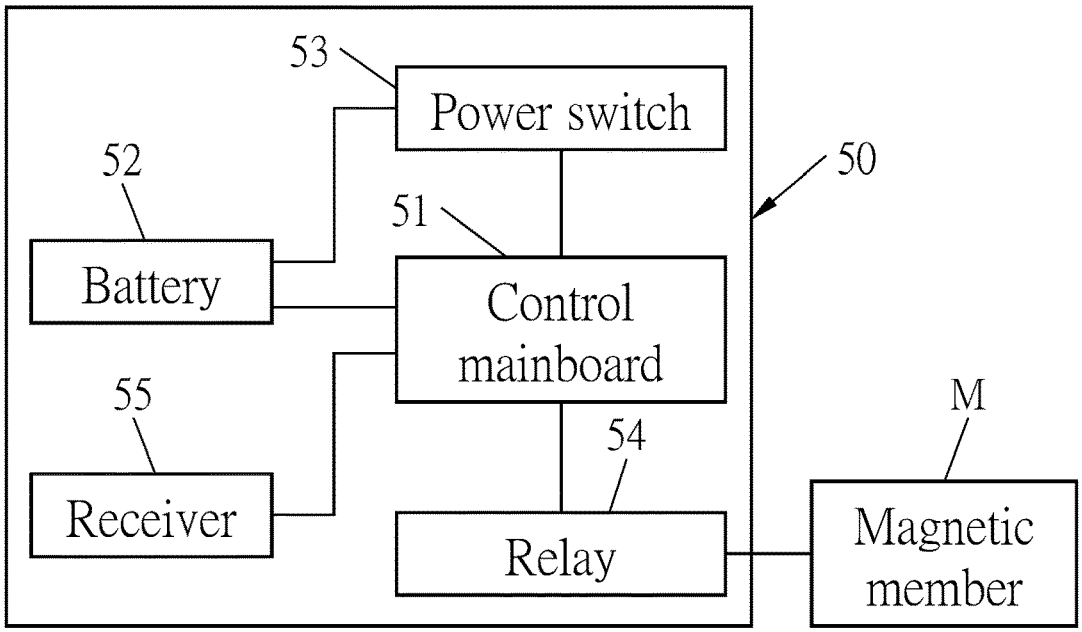
FIG. 13 is a schematic view of the control circuit module according to a preferred embodiment of the present invention.

Furthermore, referring to FIG. 13, the invention further includes a power switch 53, and the battery 52 is electrically connected to the power switch 53. The power switch 53 is provided to control the switch on/off of the battery 52.

To be more specific, the polygonal 3D building blocks K can be building material or can be constructed to be robotic arm, and when the control circuit module 50 controls the electromagnets, the polygonal 3D building blocks K can be changed to have different arrangement and assembly relationships. When the size of the polygonal 3D building blocks K is large, it can be assembled into a building block.

The above provides description of the structural configurations of main components of exemplary embodiments of the present invention. The actuation method and technical effects of the present invention are further explained in the following.

Figure 4:
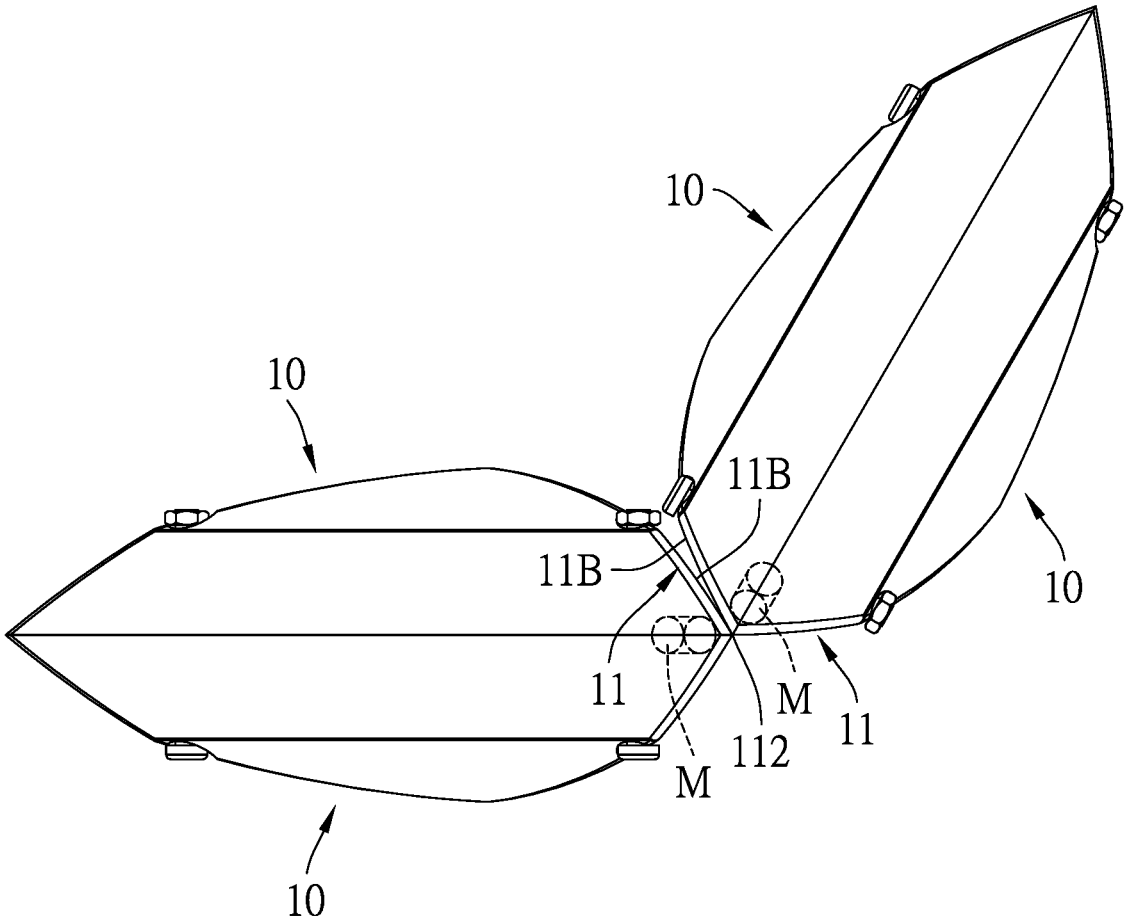
FIG. 4 is a schematic view showing an assembly of a plurality of the assemblable polygonal 3D building blocks.
Figure 5:
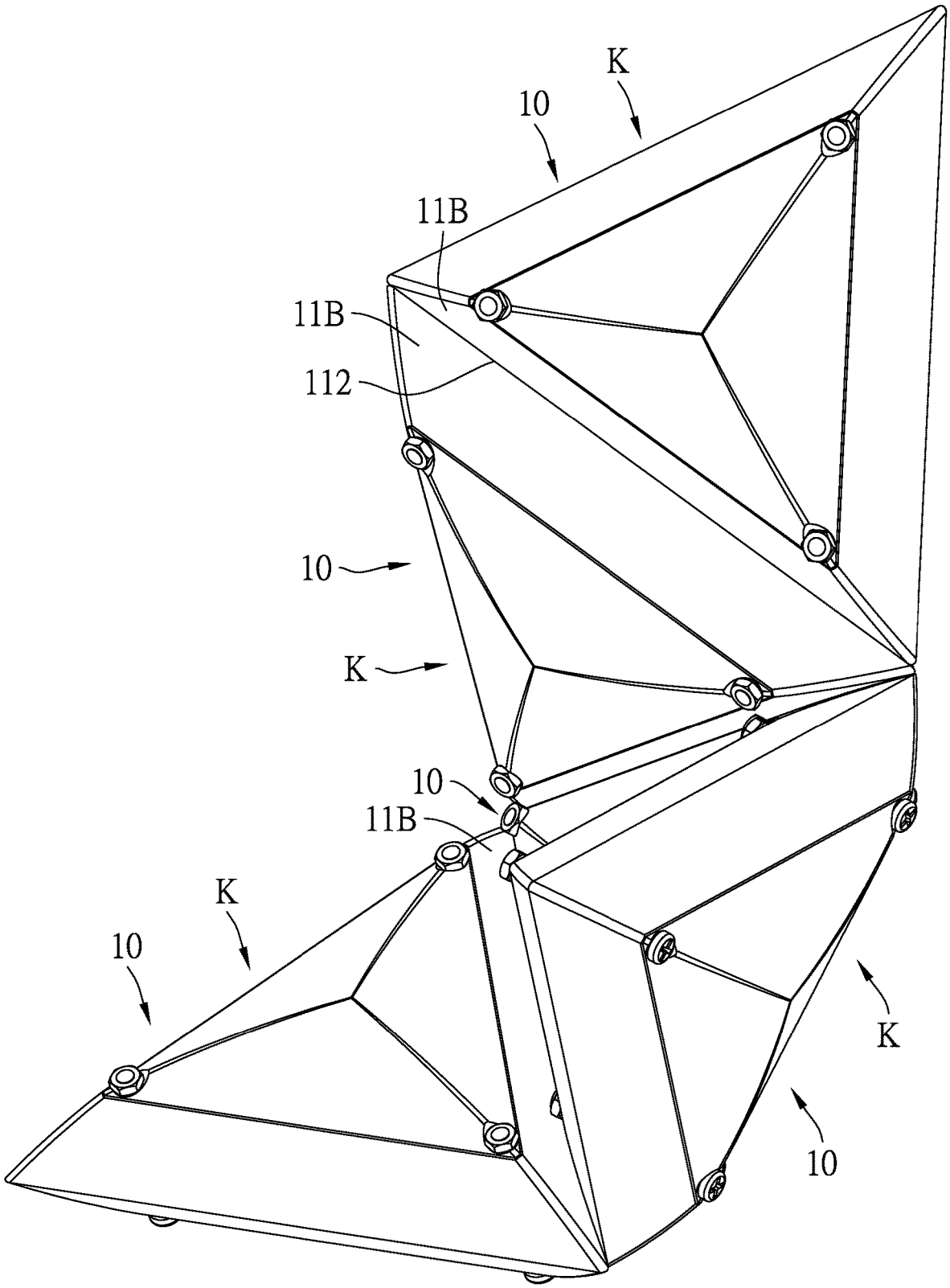
FIG. 5 is a schematic view showing an assembly of a plurality of the assemblable polygonal 3D building blocks.

As shown in FIGS. 4 and 5, when the polygonal 3D building blocks K approach each other, the magnetic members M of each one of the polygonal 3D building blocks K are magnetically attracted to each other, such that the outer abutment surface 11B and/or the second side edges 112 of each one of the polygonal 3D building blocks K abut against each other, thereby allowing the polygonal 3D building blocks K to be assembled to form different shapes depending upon the user's arrangement.

Furthermore, as shown in FIGS. 10 and 12, the control circuit module 50 is used to control the magnetic attachment of the magnetic members M, such that the attachment method of each one of the polygonal 3D building blocks can be controlled independently, in order to change the arrangement type of each polygonal 3D building block K via remote control method, thereby making the control method more convenient

What is claimed is:

1. Assemblable polygonal three-dimensional building blocks, comprising:

two main bodies each having a central area and at least three abutment side walls, the central area located among the abutment side walls, and the two main bodies assembled to each other;

the abutment side walls connected to each other in a ring shape and having a slanted surface respectively, each one of the abutment side walls having a first side edge, a second side edge, and two connecting side edges respectively, the first side edge and the second side edge arranged at two opposite sides of each one of the abutment side walls, the central area located between the first side edges of the abutment side walls, wherein a length of the second side edge is greater than a length of the first side edge, the first side edges and the second side edges each have one connected with one of the connecting side edges, and have the other end connected with the other one of the connecting side edges, the connecting side edges of each of the abutment side walls are connected with each other, the abutment side walls each have an outer abutment surface, the abutment side walls include an inner surface opposite from the outer abutment surface, the main bodies each further include a plurality of inner walls, each one of the inner walls is connected to the inner surface of the two abutment side walls, a plurality of magnetic attachment areas are defined by the inner walls and the abutment side surfaces;

a plurality of magnetic members installed at the plurality of magnetic attachment areas, and the plurality of magnetic members are electromagnets; and a control circuit module electrically connected to the plurality of magnetic members and provided for controlling magnetic attachment of the plurality of magnetic members.

2. The assemblable polygonal three-dimensional building blocks according to claim 1, wherein the abutment side walls of the two main bodies together define an included angle, and the included angle ranges between 30 and 120 degrees.

3. The assemblable polygonal three-dimensional building blocks according to claim 1, wherein the control circuit module comprises: a control mainboard, a battery, a relay and a receiver, the receiver is signally connected to the control mainboard, the battery is electrically connected to the control mainboard, the control mainboard is electrically connected to the relay for controls, and the relay is electrically connected to the plurality of magnetic members, the receiver is provided to receive an external signal and to transmit the external signal to the control mainboard, thereby allowing the control mainboard to control the relay to be at an open state or a closed state based on the external signal in order to control the magnet for magnetic attachment, and the battery is provided to supply an electrical power.

4. The assemblable polygonal three-dimensional building blocks according to claim 1, wherein the central area includes a central through hole.

* * * * *